US005378162A

United States Patent [19]

Waible

[11] Patent Number: 5,378,162

[45] Date of Patent: Jan. 3, 1995

[54] ELECTRICAL PLUG BRIDGE FOR AN APPLIANCE PLUG

[75] Inventor: Thomas Waible, Waldbronn, Germany

[73] Assignee: Taller GmbH, Waldbronn, Germany

[21] Appl. No.: 217,990

[22] Filed: Mar. 25, 1994

Related U.S. Application Data

[63] Continuation of Ser. No. 981,332, Nov. 24, 1992, abandoned.

[30] Foreign Application Priority Data

Apr. 3, 1992 [DE] Germany ..... 4211739

[51] Int. Cl.[6] ..... H01R 19/08

[52] U.S. Cl. ..... 439/106; 439/606

[58] Field of Search ..... 439/695, 697, 874, 606, 439/106, 736

[56] References Cited

U.S. PATENT DOCUMENTS

| | | | |
|---|---|---|---|
| 3,086,251 | 4/1963 | Bernat | 439/695 |
| 3,095,470 | 6/1963 | Dozier | 439/733 |
| 3,609,630 | 9/1971 | Francis | 439/106 |
| 3,611,257 | 10/1971 | Carkhuff | 439/606 |
| 3,909,095 | 9/1975 | James et al. | 439/106 |
| 4,043,630 | 8/1977 | Suverison et al. | 439/606 |
| 4,718,865 | 1/1988 | Cordeiro | 439/695 |

FOREIGN PATENT DOCUMENTS

| | | | |
|---|---|---|---|
| 2585190 | 1/1987 | France | 439/874 |
| 2592743 | 7/1987 | France | 439/874 |
| 1515438 | 8/1969 | Germany | 439/106 |

*Primary Examiner*—Gary F. Paumen
*Attorney, Agent, or Firm*—Baker & Daniels

[57] ABSTRACT

A plug bridge for an electrical appliance plug having a pair of conductor pins in which the power cord leads are attached by a thermal joining process such as welding or soldering. Insertion channels are formed within the insulating element of the plug bridge to prevent portions of the power cord leads from contacting one another. The conductor pins are constructed from flat sections including a 90° turn of a connecting portion for proper attachment of the power cord leads.

20 Claims, 3 Drawing Sheets

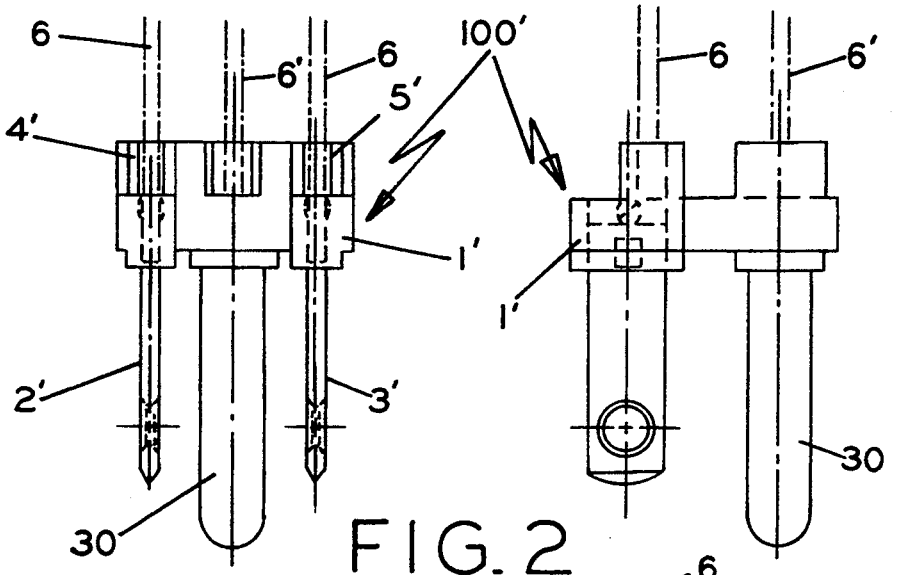
FIG. 2
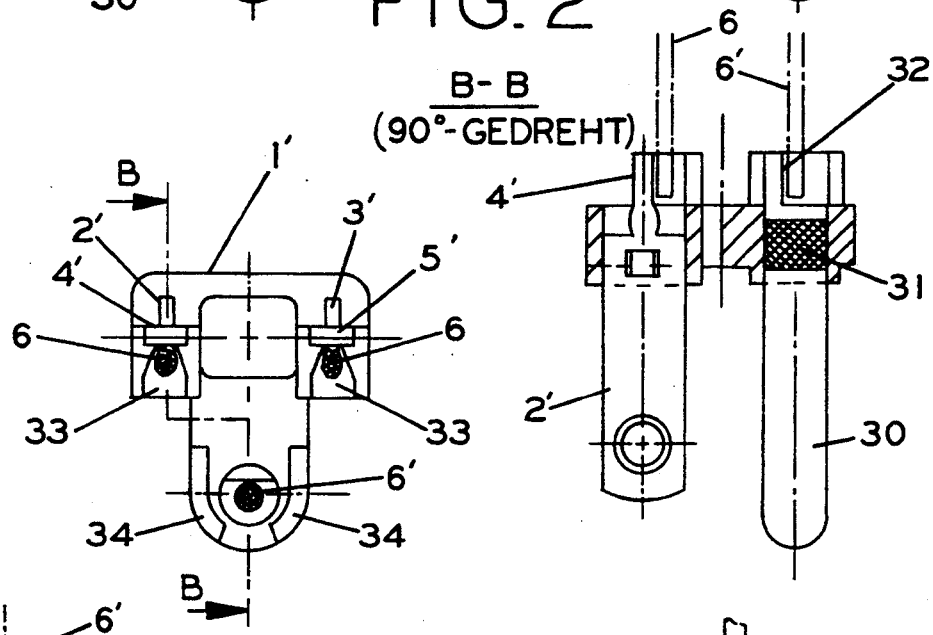
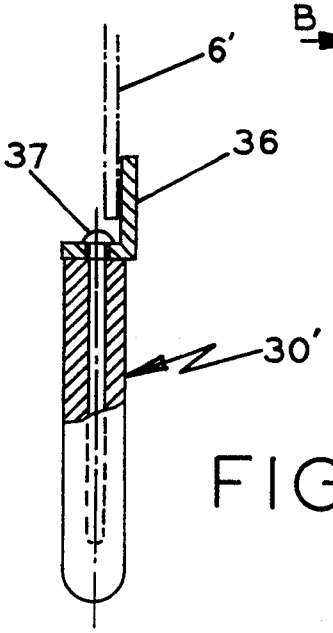
FIG. 5
FIG. 4
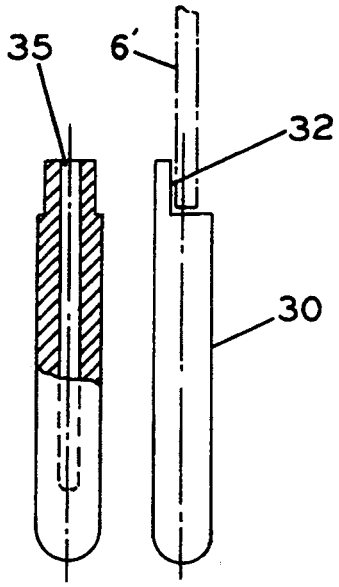

ELECTRICAL PLUG BRIDGE FOR AN APPLIANCE PLUG

This is a continuation of application Ser. No. 07/981,332, filed Nov. 24, 1992, now abandoned.

BACKGROUND OF THE INVENTION

The present invention concerns a plug bridge for an electrical appliance plug.

Plug bridges and appliance plugs are known, such as two-pole plugs with a pair of current conductor pins (hereafter termed contact pins). Another such plug is a three-pole plug with a pair of contact pins and a safety pin (hereafter called ground pin). The design of the ground pin is such that it is parallel to the contact pins.

The electrical safety of appliance plugs is very important. Today's appliance plugs consist of plug elements that are encapsulated in the interior of a cast or injection-molded plug including electrical connections between an appliance power cord connector pins for connection to an outlet.

For electrical safety, the electrical connections inside the appliance plug are outwardly absolutely firm and tight, i.e., it must be assured that the power cord can under no circumstances be pulled off, and that none of the strands of the power cord leads protrude in any way outside through the contour of the plug. Similarly, it must also be assured that the connector pins situated inside the appliance plug are safely insulated relative to one another and remain so after completion of the appliance plug.

According to the prior art, the power cord leads are inserted by way of so-called insertion funnels into complementary hollow-cylindrical connector pins. These latter are then crimped in such a way that the leads will be firmly joined to the connector pins. This crimp technique, by and large, has proven itself.

SUMMARY OF THE INVENTION

The problem underlying the present invention consists in providing a plug bridge of the initially named type with an alternative connection technique for the leads and the connector pins.

This problem is solved by having the power cord leads fixed to the connector pins of the contact pins and, as the case may be, also of the ground pin using a thermal joining process, for instance as by welding or soldering.

The inventionally proposed thermal joining procedure assures that the leads will be firmly and stably joined to the conjugated connector pins.

To assure electrical safety, the insulating body has a wall molded to it which protrudes beyond its plane and can capture protruding strands of the leads. Special characteristics regarding the flat pins and the round pin are further discussed below.

The invention, in one form thereof, provides a plug bridge for an electrical appliance plug for connection to an AC outlet. The plug bridge includes a plurality of connecting pins in a dimensionally stable insulating element having cutouts corresponding to the cross section of the conductor pins. The conductor pins are inserted into the cutouts with the pins protruding relative to the insulating element far enough for insertion into the AC outlet. Stripped portions of powered cord leads are joined to sections of the conductor pins within the contours of the appliance plug with the leads joined to the conductor pins by leads of thermal joining. A channel is provided alongside the conductor pins to prevent stray leads.

BRIEF DESCRIPTION OF THE DRAWINGS

The invention will hereafter be illustrated in detail with the aid of the drawing, which shows in FIG. 1 is a two-pole plug bridge in three views, along with a sectional illustration;

FIG. 2 is a three-pole plug bridge in three views, along with a sectional illustration;

FIG. 4 is a round pin according to FIG. 2, for forming the ground pin, in two views;

FIG. 5 is a second embodiment of a round pin according to FIG. 4;

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
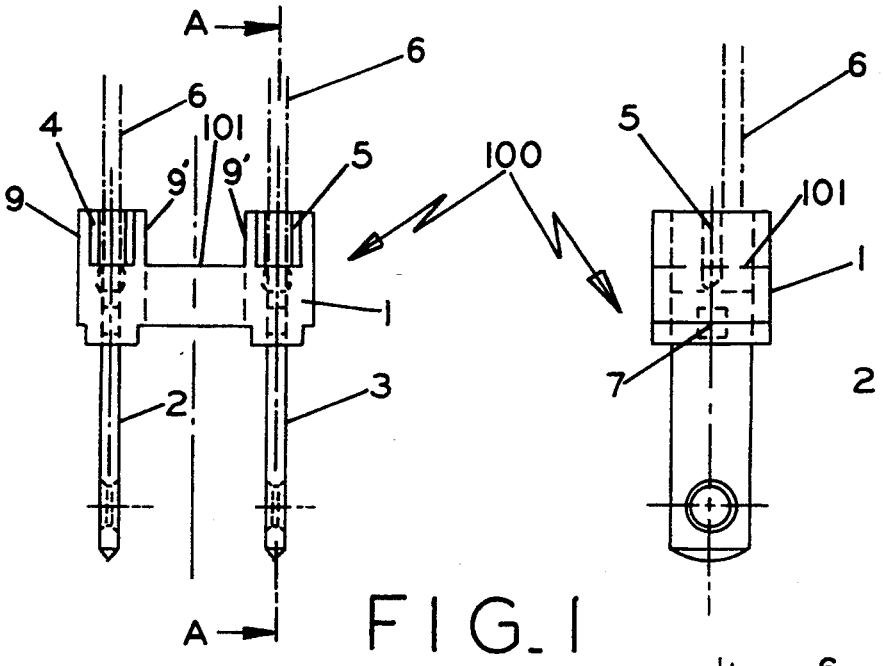

The plug bridge 100 according to FIGS. 1 and 2 consists of a dimensionally stable insulating element 1, 1' formed of hard-elastic plastic whose shape, i.e., its outer form, is determined by a flat plate part. This flat plate part has in the case of the two-pole plug bridge (FIG. 1) the basic shape of a block, while in the case of the three-pole plug bridge (FIG. 2) it has the form of a "T".

According to the embodiment of FIG. 1, the plug bridge features two metallic pins 2, 3 inserted into cutouts of the insulating element 1 and serving both as contact pins (hot or neutral conductors) when the appliance plug originating from this plug bridge 100 is inserted in an outlet. The cutouts correspond to the cross section of the contact pins. According to the illustrated embodiment, these metallic pins 2, 3 are fashioned as rectangular flat pins protruding on the first side (i.e., underside) of the insulating element 1. On the second side (i.e., topside) of the insulating element 1, these flat pins are so shaped that they can be used as connector pins 4, 5 for the soldered or welded (dash-dotted) leads 6 of a power cord for an electrical appliance, in accordance with the invention. It is pointed out with regard to the flat pins, these metallic pins 2, 3 can both be pressed by way of positive locking into complementary cutouts in the insulating element 1 and also fixed in conjunction with injection-molding the insulating element 1. Likewise integrated for both types of connections is a complementary lock joint 7 provided in insulating element 1 and the respective pin 2, or 3.

The configuration described above—viewed strictly geometrically—is known as such. The present invention relates to the specific design of the flat pins 2, 3 in view of the connection to the leads 6 of a power cord and of a modification of the insulating element 1 adapted thereto.

Figure 3:
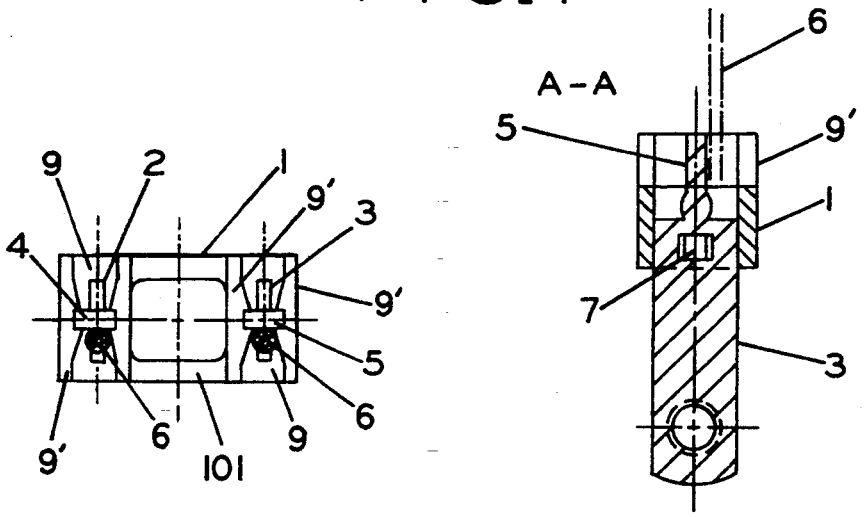
FIG. 3 is a flat pin according to FIG. 1 and 2 for forming the contact pin in a basic illustration, viewed in manufacturing respects, and a functional illustration with a shaped connector pin.
Figure 3:
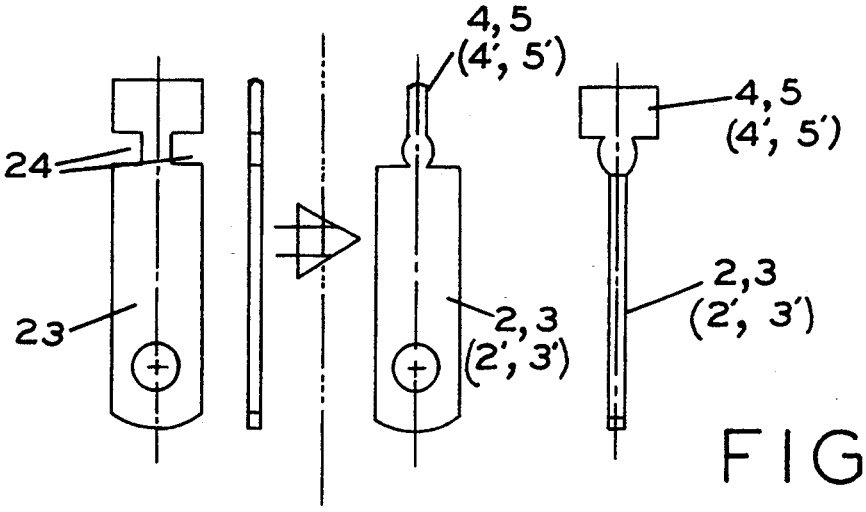

The flat pins 2, 3, as shown in FIG. 3, consist of an essentially metallic rectangular flat blank 23 featuring a rectangular relief 24 along both of its long sides. These reliefs 24 are dimensionally coordinated so that they border on the top side of the insulating element 1. This corresponds to the basic form of the flat pins 2, 3 at the left side in FIG. 3. To form the inventional plug bridge 100, the parts of the flat section 23 separated by the reliefs 24 are turned (or alternately twisted) 90° relative to each other as seen in the right-hand illustration of FIG. 3, whereby the said connector pins 4, 5 are obtained.

The flat pins 2, 3 illustrated with the aid of FIG. 3 are in a known fashion inserted in the insulating element 1, or molded into it. The turned, or alternately twisted, part of the flat pins 2, 3 (i.e., the connector pins 4, 5) now serve as assembly pins (or as a contact surface) for a lead 6 (see plan view in FIG. 1). For the sake of completeness it is also noted that the twisted parts of the flat pins 2, 3 serving as connector pins 4, 5, respectively as assembly pins, are rounded on their exposed end sides, or at least bent over.

For ease in manufacturing, and for the safe insertion and assembly of the leads 6 to the said connector pin 4, 5, a sideways-opening conic insertion channel 9 is provided on both sides of these connector pins, so that the insulating element insofar has a rotationally symmetric structure. Insertion channels 9 protrude beyond the top plane 101 of the insulating element 1 and thus form toward these cross sides and relative to one another, a safety wall 9'. The height of this safety wall 9' is chosen to correspond to the stripping length of the leads 6 to be connected so that should a strand of the lead 6 be bent outward, this strand will safety remain behind the safety wall 9'.

Following the soldering or welding of the leads 6 of the power cable, the plug bridge 100 illustrated in FIG. 1 is then molded so that a plug element is obtained with contact pins 2, 3 protruding on one side.

The three-pole plug bridge 100' according to FIG. 2 consists of a T-shaped insulating element 1' which, in keeping with the known and standardized triangular arrangement, features a metallic pin 2', 3' each as contact pins like the flat pins as in FIG. 1, and additionally a metallic round pin 30 as the ground pin. The ground pin is longer than the two others. All three pins protrude beyond the plane of the insulating element 1 sufficiently far that, with the plug element molded, they protrude sufficiently for insertion in an outlet.

The two flat pins 2', 3' are on their second (inner) ends shaped again analogous to the embodiment relative to FIG. 1 and 3, thus forming the connector pins 4', 5' for the (dash-dotted) leads 6 (current conductors) of the power cord. The round pin 30 for the ground lead 6 of the power cord, in turn, sits firmly in the insulating element 1' through the intermediary of a peripheral knurling 31.

In view of the problem underlying the present invention, the round pin 30 features on its inner end a flat 32 to which the ground lead 6' of the power cord is soldered or welded. The alignment of this flat 32 is such that it faces the cross web of the T-shape of insulating element 1'.

Analogous to the two-pole plug element 100 according to FIG. 1, the three-pole plug element 100' shown in FIG. 2 features for each of the connector pins 4', 5' (i.e., the assembly pins), a conic insertion channel 33, which in this case, however, is provided only once on the side facing the ground lead 6'. Coordinated with the ground pin, or round pin 30, and adjacent to the center web of the T-shape of the insulating element 1', is a two-part collar 34 which, for the case of bent-out strands of the ground lead 6, forms a safety wall.

A round pin 30 of the type illustrated with the aid of FIG. 2 is shown in FIG. 4 in two views. This round pin 30 shows clearly how the ground lead 6' is soldered, or welded, to the flat 32. Specifically, the illustration of FIG. 4 also shows that for reasons of saving material, the round pin 30 may be coaxially drilled (compared to reference 35). Furthermore, the round pins 30 can be made also of rolled sheet metal blanks.

Illustrated in FIG. 5 is a second embodiment of a round pin 30'. It consists of a round pin and as compared to FIG. 4 on its end is not flattened; but rather has on its end face an L-shaped fixture 36 riveted in place by rivet 37. The ground lead 6' of the power cord is then connected to the inside of this L-shaped fixture 36.

The ground prong 30 or round prong 30', according to FIGS. 4 and 5, may also be fashioned so that the bore 35 expands in funnel fashion toward the free end side, thus making it better suited for insertion of the ground lead 6'.

Figure 6:
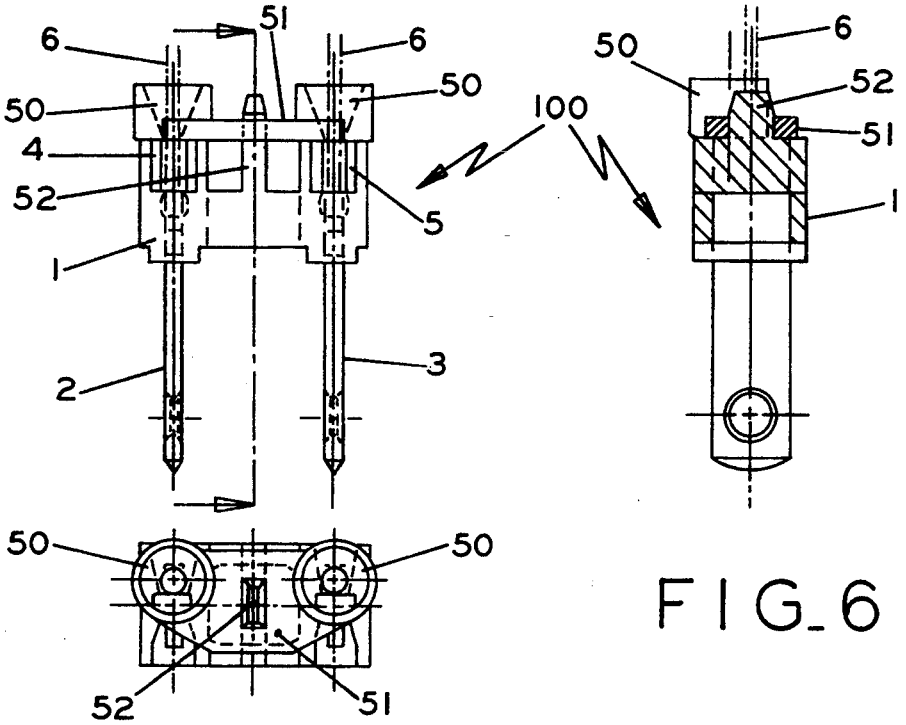
FIG. 6 is a two-pole plug bridge in three views with an additional formed part for realization of insertion funnels.
Figure 7:
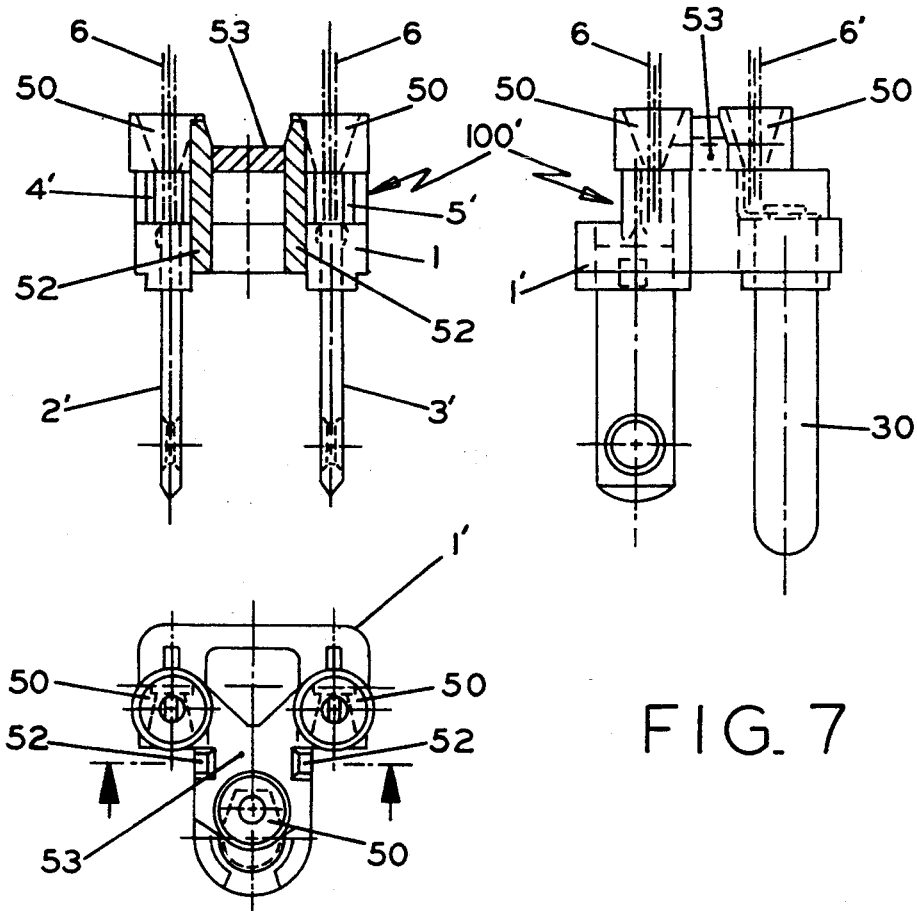
FIG. 7 is a three-pole plug bridge in three views with an additional formed part for realization of insertion funnels.

FIGS. 6 and 7 illustrate embodiments of a two-pole plug bridge 100 according to FIG. 1 and a three-pole plug bridge 100' according to FIG. 2, respectively. Both plug bridges 100 and 100' correspond to those relative to FIGS. 1 and 2, respectively, and corresponding reference numerals identify like parts.

In supplementation, or modification, of the two plug bridges 100 and 100' relative to FIG. 1 and 2, respectively, provisions are to have the connecting pins 4, 5 and respectively 4', 5' for the leads 6, as well as the inner end section of the round prong 30 for connection to the ground lead 6', each preceded by a conic insertion funnel 50. As the leads 6 and the ground lead 6' are inserted, conic insertion funnel 50 safeguards, from the outset, that the strands of the leads will safely extend to their contact surface.

According to the embodiment relative of FIG. 6, the two insertion funnels 50 are integrated in a common bridge type shaped piece 51. This shaped piece 51 opposes the two connecting pins 4, 5 and is positively and nonpositively slipped on a lock pin 52, which is molded to the insulating element 1 and extends through the shaped piece 51. The lock pin 52 and the shaped part 51 are fashioned complementary to each other and held securely as the shaped piece 51 sits firmly on the lock pin 52 and is injection molded to the plug body.

According to the embodiment relative to FIG. 7, all three insertion funnels 50 for the connecting pins 4', 5' of the leads 6 for connection of the ground lead 6' are integrated into common shape, for instance, T-shaped form piece 53. The form piece 53 opposes the connecting pins 4', 5' and the inner end of the round prong 30. Analogous to the embodiment shown in FIG. 6, the form piece 53 is latched onto one, but preferably two lock pins 52 and thus retained both positively and nonpositively. The lock pins are molded to the insulating element 1'. Both parts (i.e., form piece 53 and lock pin 52) are fashioned as to partially complement each other, so that the form piece 53 is secured to insulating element 1'.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A plug bridge for an electrical appliance plug for connection to an AC outlet, said plug bridge comprising:

a plurality of conductor pins;

a dimensionally stable insulating element having a top plane, said insulating element including cutouts corresponding to the cross section of each said conductor pins, said conductor pins disposed in said cutouts, said pins protruding relative to said insulating element sufficiently far for insertion into the outlet;

a power cord including leads each having a stripped portion, said leads joined to a section of said conductor pins within the contours of the appliance plug that protrude relative to said top plane of said insulating element, said leads joined to said conductor pins by means of thermal joining; and said insulating element including sideways-opening insertion channels for sideways insertion of respective said poser cord leads to be joined, each said insertion channel extending conically toward a center line of said insulating element and protruding above said top plane of said insulating element.

2. The plug bridge of claim 1 in which said insulating element is block shaped for a two pole plug, said insertion channels molded parallel to the plane of said conductor pins and parallel to a side of said insulating element.

3. The plug bridge of claim 1 in which said insulating element is T-shaped for a three pole plug, said insulating element including a collar molded in the area of the T-center web and coordinated about the protruding end of one of said conductor pins, said collar protruding beyond said top plane of said insulating element.

4. The plug bridge of claim 1 in which the height of said insertion channels is dimensioned according to the length of said stripped portion of said leads.

5. The plug bridge of claim 1 in which said each conductor pin comprises a flat section having a connecting pin located within the contour of the appliance plug, said connecting pin turned 90° relative the plane of said flat section for attachment of said power cord leads.

6. The plug bridge of claim 5 in which said flat section of said conductor pin includes narrow sides having a relief serving as a hinge for the 90° turn of said connecting pin.

7. The plug bridge of claim 1 in which a said conductor pin is constructed round to form a ground pin, said ground pin having an end located within the contour of the appliance plug, said end including a lateral recess for attachment of a lead of said power cord for grounding.

8. The plug bridge of claim 7 in which said ground pin includes on an end located inside the contour of the appliance plug an L-shaped fixture whose L-shank protrudes axially parallel away from said ground pin, said L-shank attached to a lead of said power cord for grounding.

9. The plug bridge of claim 8 in which said L-shaped fixture and said ground pin are joined by a rivet.

10. The plug bridge of claims 7 in which said round conductor pin includes a center bore.

11. The plug bridge of claim 1 in which said flat pins and said insulating element include complementary lock joints for attachment therebetween.

12. The plug bridge of claim 1 in which said conductor pin is partially knurled for attachment to said insulating element.

13. The plug bridge of claim 1 in which said insulating element has conic insertion funnels for respective said insertion channels.

14. The plug bridge of claim 13 in which said insulating member includes a protruding lock pin, said insertion funnels being formed by a common bridge type formed piece that connects to said lock pin.

15. The plug bridge of claim 13 for a three pole plug in which said insulating element includes at least one lock pin, said insertion funnels being formed by a common T-shaped formed piece that connects to a said lock pin.

16. The plug bridge of claim 1 in which said insulating element is T-shaped for a three pole plug, said insulating element including a collar molded in the area of a T-center web and coordinated about the protruding end of one of said conductor pins, said collar protruding beyond the top plane of said insulating element.

17. The plug bridge of claim 16 in which the height of said insertion channels is dimensioned according to the length of said stripped portion of said leads.

18. The plug bridge of claim 2 in which said each said conductor pin comprises a flat section having a connecting pin located within the contour of the appliance plug, said connecting pin turned 90° relative the plane of said flat section for attachment of said power cord leads.

19. The plug bridge of claim 3 in which said insulating element has conic insertion funnels for respective said insertion channels.

20. The plug bridge of claims 7 in which said round conductor pin includes a center bore.

* * * * *